US005388344A

United States Patent [19]

Wallach

[11] Patent Number: 5,388,344

[45] Date of Patent: Feb. 14, 1995

[54] MINIATURE CLOTHES DRYER

[76] Inventor: Beth K. Wallach, 31 Park Cir., White Plains, N.Y. 10603

[21] Appl. No.: 204,115

[22] Filed: Mar. 1, 1994

[51] Int. Cl.[6] ..... F26B 19/00

[52] U.S. Cl. ..... 34/91; 34/603; 34/602

[58] Field of Search ..... 34/90, 91, 603, 607, 34/202, 151, 572, 599, 602; 392/360, 379

[56] References Cited

U.S. PATENT DOCUMENTS

| | | | |
|---|---|---|---|
| D. 183,665 | 10/1958 | Sundberg | D49/1 |
| D. 314,070 | 1/1991 | Rubin | D28/54.1 |
| 1,544,884 | 7/1925 | Braley | 34/607 |
| 3,064,361 | 11/1962 | Turner | 34/603 |
| 3,157,475 | 11/1964 | Stainbrook | 34/90 |
| 3,360,871 | 1/1968 | Wattenford | 34/90 |
| 4,213,250 | 7/1980 | Hawkins | 34/53 |
| 4,868,998 | 9/1989 | Rubin | 34/91 |
| 4,918,290 | 4/1990 | DeMars | 34/202 |
| 5,014,446 | 5/1991 | Reesman | 34/239 |

*Primary Examiner*—Denise L. Gromada
*Attorney, Agent, or Firm*—Karl F. Milde, Jr.

[57] ABSTRACT

A miniature clothes dryer is adapted to operate in combination with a portable hair dryer that includes a heating element, an air blower for passing air across the heating element and a hot air outlet nozzle. The clothes dryer comprises a dryer housing having an inlet opening to receive and retain the outlet nozzle of the portable hair dryer. The housing also has an outlet opening for discharging air and a door for the insertion and removal of items of clothing. Mounted for rotation within the housing is a clothes drying drum having walls for supporting and tumbling the clothes which are inserted through the housing door. Drive means with an electric motor are provided for rotating the drum. The drum walls have a plurality of openings for the passage of air and the housing has a plurality of baffles for directing hot air from the nozzle of a hair dryer at the inlet opening to the inside of the drum, and from the inside of the drum to the outlet opening.

5 Claims, 3 Drawing Sheets

MINIATURE CLOTHES DRYER

BACKGROUND OF THE INVENTION

The present invention relates to a miniature—i.e., small—clothes dryer which may be either portable or wall mounted.

Clothes dryers as household appliances are well known in the art. Such dryers are disclosed in numerous patents such as the U.S. Pat. No. 4,213,250 and U.S. Pat. No. Des. 183,665. Conventional clothes dryers of this type are provided with a rotatable drum or tumbler for tumbling clothes; a heating element for generating heated air; a blower for moving heated air through the tumbler and a dust filter for filtering lint entrained in the air before the air is exhausted through an outlet.

While such clothes dryers are extremely convenient to use, they require a special installation in a laundry room or the like so that the exhausted air may be piped through a building outlet.

While conventional clothes dryers have a capacity for drying several pounds of clothes, it is often desirable to dry just one or two items of clothing such as a pair of socks, underwear or a bathing suit. Such items are normally hung out to dry on a clothes rack or a clothes line in order to avoid operating a conventional clothes dryer for such a minor task. In a hotel room, such items are often hung in the bathroom, for example, over the bathtub.

Several attempts have been made to design and produce a miniature clothes dryer which would dry one or two items of clothing in reasonably quick order. However, none of these prior clothes dryer designs have proven successful. The U.S. Pat. No. 4,918,290 discloses a "portable towel heating device" which incorporates a self-contained source of heat and may be used to warm or dry towels in the folded condition. Since the towels remain stationary during the drying process, drying takes an inordinate length of time.

Similarly, the U.S. Pat. No. Des. 314,070 provides a "wall mounted garment dryer" which is simply a box for insertion of small items of clothing. Hot air is provided to this box through a dryer nozzle and hose from an external source, not shown.

SUMMARY OF THE INVENTION

It is an object of the present invention, therefore, to provide a miniature clothes dryer which is effective to rapidly dry individual items of clothing.

It is a further object of the present invention to provide a miniature clothes dryer which is relatively simple to manufacture and convenient to use.

These objects, as well as other objects which will become apparent from the discussion that follows, are achieved, in accordance with the present invention, by providing a miniature clothes dryer which is adapted to operate in combination with a portable hair dryer that includes a heating element, an air blower for passing air across the heating element and a hot air outlet nozzle. The clothes dryer comprises a dryer housing having an inlet opening to receive and retain the outlet nozzle of the portable hair dryer. The housing also has an outlet opening for discharging air and a door for the insertion and removal of items of clothing. Mounted for rotation within the housing is a clothes drying drum having walls for supporting and tumbling the clothes which are inserted through the housing door. Drive means with an electric motor are provided for rotating the drum. The drum walls have a plurality of openings for the passage of air and the housing has a plurality of baffles for directing hot air from the nozzle of a hair dryer at the inlet opening to the inside of the drum, and from the inside of the drum to the outlet opening.

In a preferred embodiment, an electrical switch is provided for switching electrical power to the electric motor. The electrical switch is operative to switch off the electric motor when the door is opened.

In the preferred embodiment, the housing is also provided with a removable lint filter arranged at the outlet opening which catches air-entrained lint as it passes through the outlet opening.

The miniature clothes dryer may either be placed on a table or mounted on a wall, for example in a bathroom. For the latter purpose, wall mounting brackets are preferably affixed to the back of the dryer housing.

By using hot air generated by a hair dryer the clothes dryer mechanism is considerably simplified. In use, an operator places the outlet nozzle of a hair dryer into the inlet opening of the dryer housing, inserts an item of clothing into the drying drum through the housing door, closes the door and switches on the dryer drive motor. After tumbling for several minutes within the dryer, the clothing is dried by the passage of hot air produced by the hair dryer.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
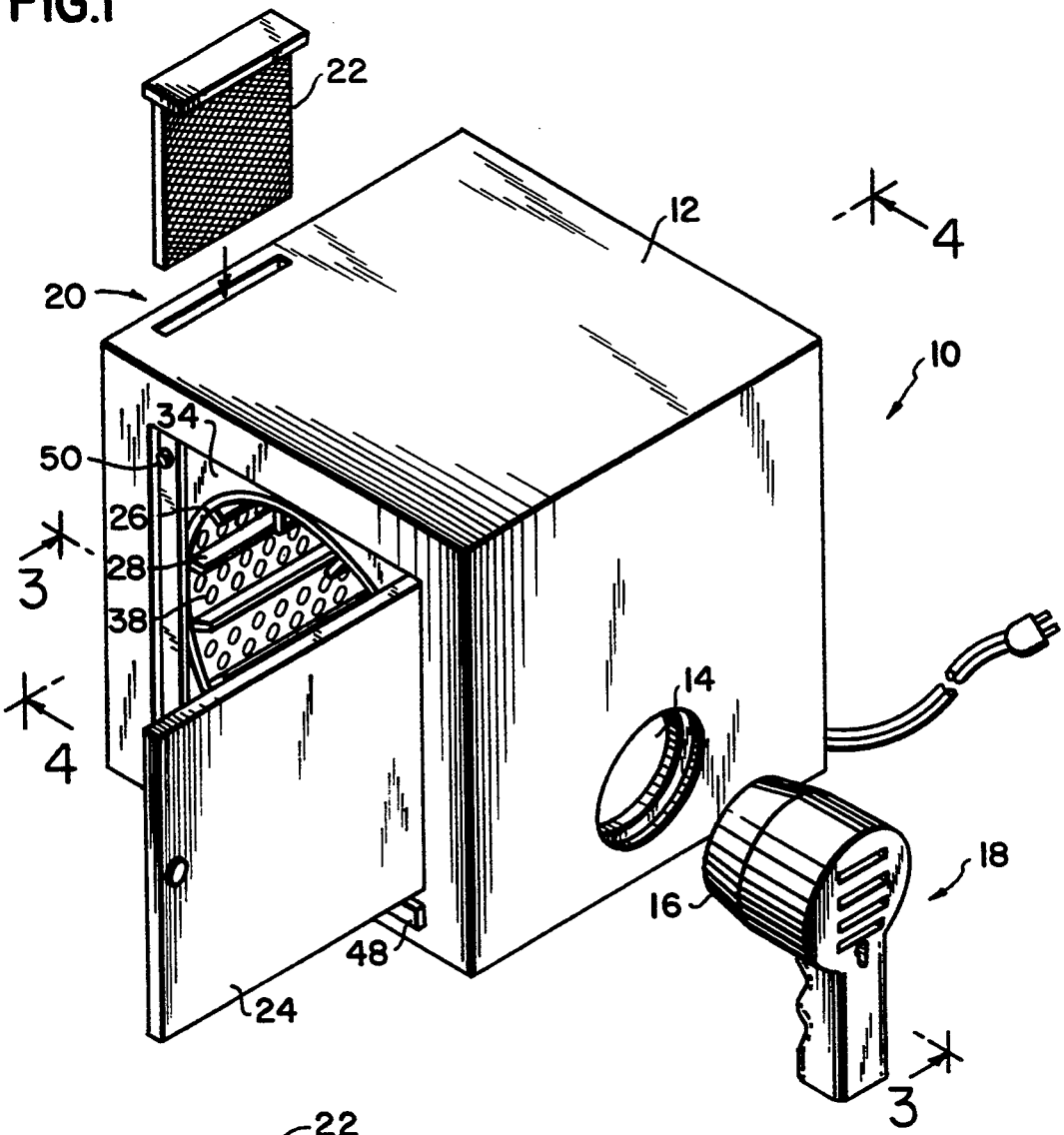
FIG. 1 is a perspective view of the miniature clothes dryer according to the preferred embodiment of the present invention.
Figure 2:
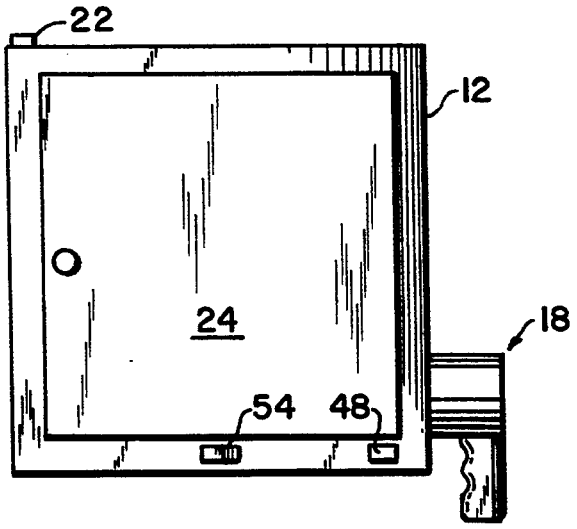
FIG. 2 is a front elevational view of the clothes dryer of FIG. 1.

The preferred embodiments of the present invention will now be described with reference to FIGS. 1–8 of the drawings. Identical elements in the various figures are designated with the same reference numerals.

FIG. 1 illustrates the miniature clothes dryer 10 according to the preferred embodiment of the present invention. This appliance comprises a dryer housing 12 having an inlet opening 14 to receive and retain the outlet nozzle 16 of a portable hair dryer 18. The housing also has an opening 20 disposed behind a removable lint filter 22 and a door 24 for the insertion and removal of items of clothing.

Figure 4:
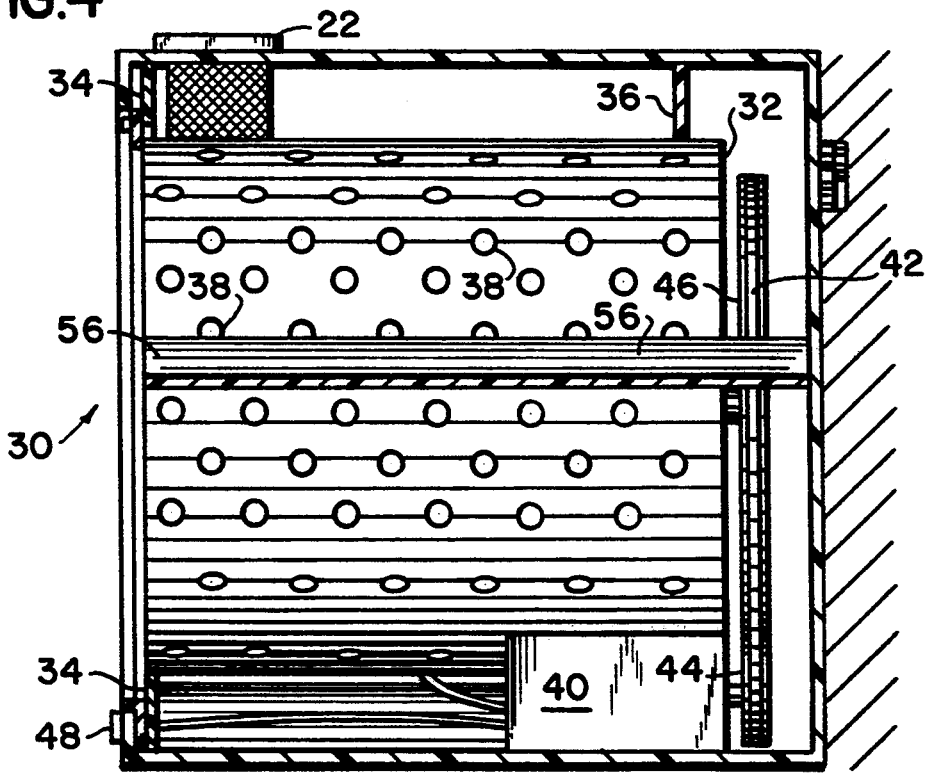
FIG. 4 is a cross-sectional view of the clothes dryer of FIG. 1 taken along the section line 4—4.

Mounted for rotation within the housing is a clothes drying drum 26 having ribs 28 for tumbling the items of clothing. The drum 26 is open at the end 30 facing the door 24 and closed at the opposite end 32 (FIG. 4). The drum is supported within the housing by supporting walls 34 and 36, which are preferably made of durable plastic. The cylindrical wall of the drum is provided with a plurality of openings 38 for the passage of air.

The clothes drum is rotated by a drive mechanism comprising an electric motor 40 and a V-belt 42 which is permanently mounted on pulleys 44 and 46. The electric motor is controlled by an on/off switch 48 as well as by a limit switch 50 that automatically switches the motor off when the door is opened.

If desired, a light 54 may be provided to indicate that the motor 40 is operating.

Figure 3:
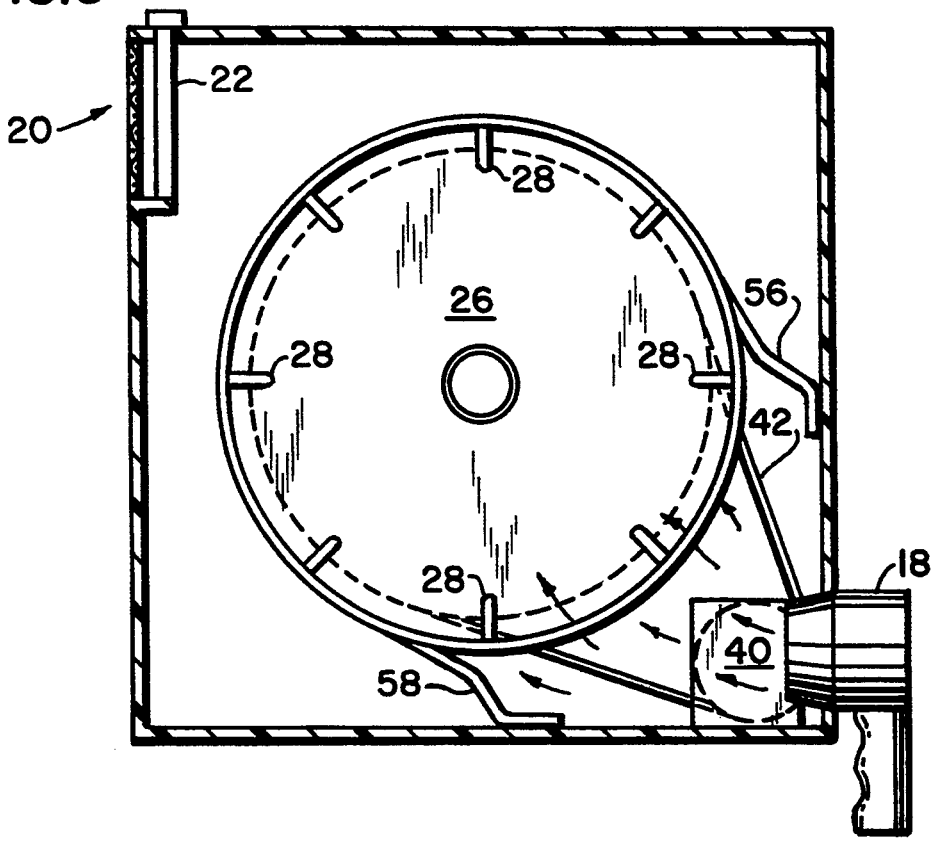
FIG. 3 is a cross-sectional view of the clothes dryer of FIG. 1 taken along the section line 3—3.

As is illustrated in FIG. 3, baffles 56 and 58 are provided to insure that hot air from the hair dryer 18 passes through the drum 26 on its way to the outlet 20.

Figure 5:
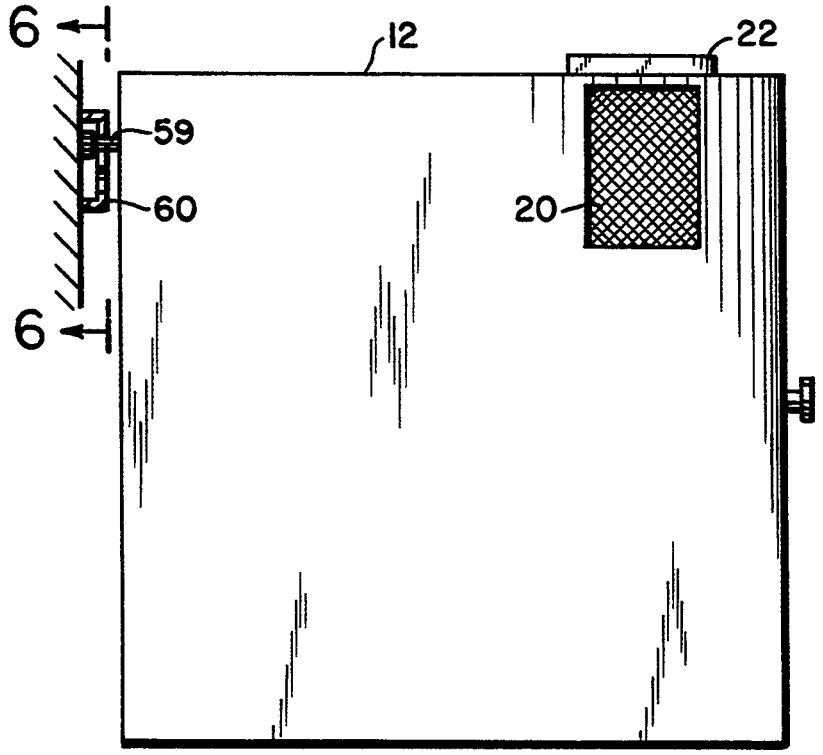
FIG. 5 is a side elevational view of the clothes dryer of FIG. 1.
Figure 6:
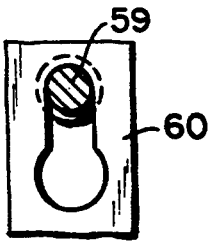
FIG. 6 is a detailed view showing a mounting bracket for mounting the clothes dryer on a wall.

The clothes dryer according to the present invention may be placed on a table, on the floor, or mounted on a wall. FIGS. 5 and 6 illustrate a bracket 60 which may be used to mount the dryer on a wall. This bracket receives a knob 59 which extends horizontally outward from the back of the housing 12.

Figure 7:
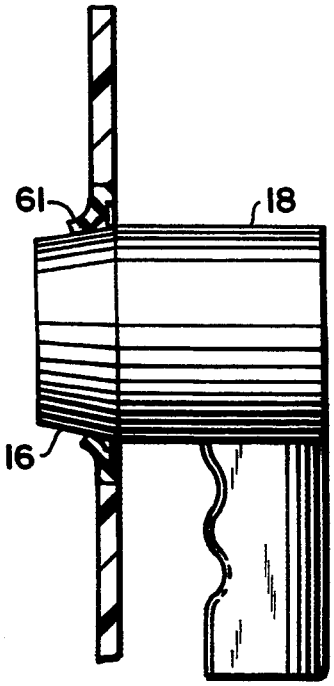
FIG. 7 is a detailed view showing the inlet opening for a hair dryer nozzle.

The hair dryer nozzle is held firmly in place by a resilient ring member 61 (FIG. 7). The ring member 61 also prevents hot air from escaping through the inlet 14.

As is best illustrated in FIGS. 1, 3 and 4, the removable lint filter 22 prevents lint from reaching and escaping through the outlet opening 20. The lint filter 22 may be removed from time to time and cleaned by the operator of the clothes dryer.

In use, the operator places the nozzle 16 of a hair dryer 18 in the inlet opening 14, places clothes within the tumbler drum 26, closes the door 24 and presses the on/off switch 48. After several minutes, depending upon the size and dampness of the items of clothing, the door is opened and the clothes are removed. Before or after removal of the clothes, the hair dryer 18 is switched off and removed from the inlet opening 14.

Figure 8:
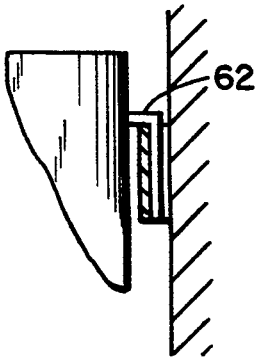
FIG. 8 is a detailed view showing an alternative mounting bracket for mounting the clothes dryer on a wall.

FIG. 8 shows an alternative embodiment wherein a wall bracket receives a vertically extending "hook" 62 formed in the back of the housing.

There has thus been shown and described a novel miniature clothes dryer which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A miniature clothes dryer adapted to operate in combination with a hair dryer that includes a heating element, an air blower for passing air across said heating element and a hot air outlet nozzle, said clothes dryer comprising, in combination:

(a) a dryer housing having an inlet opening to receive and retain the outlet nozzle of a hair dryer, an outlet opening for discharging air passed through the dryer housing and a door for insertion and removal of clothes;

(b) a clothes drying drum, mounted for rotation within said housing and having walls for supporting and tumbling clothes inside thereof which are inserted through said housing door; and (c) drive means including an electric motor for positively rotating said drum;

wherein said drum walls have a plurality of openings for the passage of air into and out of said drum, and wherein said housing has a plurality of baffles for directing all of the hot air from said inlet opening through said openings to the inside of said drum and from the inside of said drum through said openings to said outlet opening.

2. The clothes dryer defined in claim 1, further comprising an electrical switch for switching electrical power to said electric motor on and off.

3. The clothes dryer defined in claim 2, wherein said electrical switch is operative to switch off said electric motor when said door is opened.

4. The clothes dryer defined in claim 1, further comprising a removable lint filter arranged on said housing at said outlet opening.

5. The clothes dryer defined in claim 1, further comprising mounting brackets on said housing for attaching said housing to a wall.

* * * * *